US007150851B2

(12) United States Patent
Holthausen et al.

(10) Patent No.: US 7,150,851 B2
(45) Date of Patent: Dec. 19, 2006

(54) POWDER PRESS

(75) Inventors: Matthias Holthausen, Wassenberg (DE); Martin Zingsem, Viersen (DE); Guido Schrömges, Nettetal (DE); Rolf Vest, Mönchengladbach (DE)

(73) Assignee: SMS Meer GmbH, Monchengladbach (DE)

( * ) Notice: Subject to any disclaimer, the term of this patent is extended or adjusted under 35 U.S.C. 154(b) by 0 days.

(21) Appl. No.: 11/141,672

(22) Filed: May 31, 2005

(65) Prior Publication Data

US 2005/0269729 A1 Dec. 8, 2005

(30) Foreign Application Priority Data

Jun. 2, 2004 (DE) ..... 10 2004 026 968

(51) Int. Cl.
*B22F 3/02* (2006.01)

(52) U.S. Cl. ..... 419/38; 419/66

(58) Field of Classification Search ..... 419/38, 419/66

See application file for complete search history.

(56) References Cited

U.S. PATENT DOCUMENTS 3,134,139 A * 5/1964 Wentorf, Jr. ..... 425/77
3,832,100 A * 8/1974 Baxendale ..... 425/78
4,496,299 A * 1/1985 Pettersson ..... 425/405.2
6,221,813 B1 * 4/2001 Riedel et al. ..... 505/432

FOREIGN PATENT DOCUMENTS

| | | |
|---|---|---|
| DE | 195 008 952 | 9/1996 |
| DE | 198 30 601 | 3/2000 |
| EP | 1 097 801 | 5/2001 |
| WO | 02/32 655 | 4/2002 |

* cited by examiner

*Primary Examiner*—Daniel Jenkins
(74) *Attorney, Agent, or Firm*—Andrew Wilford

(57) ABSTRACT

An apparatus for pressing a mass into a coherent workpiece has a mold body defining a chamber and a mold liner in the chamber having a generally cylindrical pressing surface centered on an axis, directed in one radial direction, and defining a mold cavity and an opposite surface directed in an opposite radial direction. A plunger is engageable axially in the cavity. The cavity holds the mass in engagement with the pressing surface and with the plunger. The plunger can be pressed axially against the mass and thereby compress the mass in the cavity. A force, typically effected hydraulically, is exerted against the liner in the one radial direction between the mold body and the opposite surface of the liner to thereby elastically deform the liner in the one radial direction toward the mass and radially compress the liner and mass in the cavity.

7 Claims, 12 Drawing Sheets

POWDER PRESS

FIELD OF THE INVENTION

The present invention relates to a press. More particularly this invention concerns such a press used to compact a mass of powder into a finished workpiece.

BACKGROUND OF THE INVENTION

It is known to make a finished shaped workpiece from a mass of powder, a deformable mass containing powder, or a deformable mass that has been partially compacted. This is done in an apparatus having a mold comprised of a mold body defining a chamber, a mold liner in the chamber defining a cavity, and a plunger engageable in the cavity. The liner has a pressing surface exposed in the cavity, generally centered on an axis, and directed in one radial direction relative to the axis, and an opposite surface directed in an opposite radial direction, and the plunger is moved axially.

With such an apparatus the mass, typically of metal powder, is confined in the mold cavity and the plunger is driven under great force into the liner, thereby compressing and compacting the mass. In some systems there are multiple pistons, typically when the liner is a cylindrical tube there are two pistons pushed into the tube axially oppositely. Further mold elements can be advanced into the cavity to form undercuts or the like, these elements being withdrawn before the finished workpiece is demolded.

In the most common system the mold body is basically annular and the liner is a cylindrical tube centered in the mold body and formed of an extremely strong and deformation-resistant material such as a high-grade steel. The plungers are pressed axially oppositely as mentioned above into the liner to compress the mass, thereby forcing it radially outward against an inner pressing surface of the liner. Even though the liner is braced against the mold body, the enormous forces used will radially outwardly stretch the liner so that, once the plungers are withdrawn, the finished workpiece is solidly lodged in the tube and is quite difficult to remove. The mass has been deformed plastically and the liner has been deformed elastically, so these two parts are solidly fitted together. Dealing with this radial springback often puts a great deal of stress on the workpiece and on the mold liner. Even if the liner is made of hardened steel, there is still some such radial springback that retains the workpiece in the mold.

When particularly long parts are being made this problem of the workpiece getting wedged in the mold liner is particularly severe. In addition when the workpiece is long, it is necessary to use very high forces to compact the mass of powder all the way to the center, compounding the difficulties.

One solution has been to add some sort of lubricant to the powder. While a lubricant does indeed make demolding the finished part easier, it creates a finished part that is substantially softer and weaker.

WO 02/32655 of Nordell describes a powder press where the mold cavity is tapered. This makes it easier to demold the workpiece, once it has been moved a little, but to start with it is as solidly wedged in place as in a system with a cavity of nontapered cross section, and the tapered shape cannot be used in many workpieces.

German 198 30 601 of Hess describes a system where several mold parts move together to make a cruciform mold cavity in which powder is compressed. While the workpiece can be demolded relatively easily by spreading the various parts, the system has the considerable disadvantage that there is frequently leakage between the parts so that the workpiece is spoiled or needs special flash-removing operations to finish it.

Similarly, in German 195 08 952 several plungers are provided in a mold with movable undercut-forming parts. Here the structure is very complex, in particular with regard to parts that must be displaced when the powder mass is pressurized.

The system of EP 1 097 801 of Achim relates to powder pressing. Here the press actuator is a piezoactive device, but the mechanism is very complex and has the same problems with demolding the finished workpiece as the other prior-art systems described above.

In another known system called hydrostatic pressing the powder mass to be compacted is fitted in a jacket that is compressed in every direction in a body of liquid that itself is pressurized at very high pressure. Thus the mass is relatively easily separated from the jacket when the pressing job is complete, but this method does not allow for convenient mass production of standard parts In addition producing a piece to exact finish dimensions is quite difficult as they depends to a large part from the pressure employed in addition to from the shape and size of the mold.

OBJECTS OF THE INVENTION

It is therefore an object of the present invention to provide an improved pressing method and apparatus.

Another object is the provision of such an improved pressing method and apparatus that overcomes the above-given disadvantages, in particular that makes it easy to demold the workpiece while still producing a workpiece meeting tight dimensional standards.

SUMMARY OF THE INVENTION

An apparatus for pressing a mass into a coherent workpiece has according to the invention a mold body defining a chamber and a mold liner in the chamber having a generally cylindrical pressing surface centered on an axis, directed in one radial direction, and defining a mold cavity and an opposite surface directed in an opposite radial direction. A plunger is engageable axially in the cavity. The cavity holds the mass in engagement with the pressing surface and with the plunger. The plunger can be pressed axially against the mass and thereby compress the mass in the cavity. A force, typically effected hydraulically, is exerted against the liner in the one radial direction between the mold body and the opposite surface of the liner to thereby elastically deform the liner in the one radial direction toward the mass and radially compress the liner and mass in the cavity.

Thus the size of the cylindrical pressing surface is in effect adjusted. During the axial compression of the mass forming the workpiece in the mold cavity, the pressing surface is moved into the cavity, so that when the pressing operation is done, the liner can relax and in effect withdraw from the workpiece.

According to the invention the chamber is defined between the body and a piston bearing radially in the one direction on the liner. The force is exerted by pressurizing the chamber and pressing the piston in the one direction against the liner. The body can form a cylinder around the piston.

The chamber in accordance with the invention can be defined between the body and an array of pistons bearing radially in the one direction on the liner. The force is exerted by pressurizing the chamber and pressing the pistons in the one direction against the liner. The one direction can be radially inward or outward, although in most applications it is inward. In such an arrangement the pistons are radially inwardly tapered and have radial outer faces exposed in the chamber and forming a generally continuous surface.

The liner can be formed of a plurality of snugly inter fitting segments. Alternately it can be a one piece sleeve or tube.

According to the invention an array of several pistons engage respective regions of the liner. Respective cylinder chambers are provided at the pistons and different pressures in the cylinder chambers are used as the plunger is pressed against the mass in the cavity. The array can extend axially so that the regions are axially offset, or it can extend angularly so that the regions are angularly offset.

With the method of this invention the mass is confined in the cavity in engagement with the pressing surface and with the plunger. Then the plunger is pressed axially against the mass to compress the mass. A force is exerted in the one radial direction between the mold body and the opposite surface of the liner so as to elastically deform the liner in the one radial direction toward the mass and compress the liner and mass in the cavity. Normally the chamber is substantially closed and the force is exerted by pressurizing the chamber around the liner.

In accordance with the invention the liner is elastically deformed before the plunger is pressed axially against the mass. In other words, the liner is displaced in the one direction and then the mass is compressed. Thus the liner does not move at all during the axial compression of the mass so that it is not subject to deformation strain.

According to the invention the plunger is retracted axially out of engagement with the mass after compressing the mass. Then the force on the liner in the one direction is released to relax the liner out of engagement with the mass. Demolding is then a simple matter, with no particular stress to the workpiece or to the mold liner.

For best mass compaction the pressure applied in the one direction to the liner is varied during axial compression of the mass by the plunger. This variation can be done over the entire surface of the liner, or it can proceed in axially and/or angularly offset regions. The pressure can be varied to maintain the liner at a predetermined size as the mass inside it is pressurized. In these systems extremely good compaction of the mass is insured while at the same time the finished workpiece can easily be taken out of the mold at the end of the pressing operation.

With this system it is therefore possible to avoid the use of any lubricant in the mass being formed, thereby ensuring excellent particle bonding. Since the liner is in effect expanded after the forming operation so that it loosely fits around the finished workpiece, demolding of this workpiece is very easy. It is even possible to use a somewhat more cheaply constructed liner, as it is solidly hydraulically buttressed and does not need to be so very strong in an of itself. What is more the radial compression of the liner and the mass in it further ensures that the workpiece will have a hard surface when completed. The actual effective size of the liner can also be adjusted so that, if it wears a little, a little more pressurization will shrink it during pressing to the right size, increasing it service life. As a result of the hydrostatic buttressing of the liner, very high pressures can be applied to the workpiece, once again producing a high-quality and very dense finished product.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
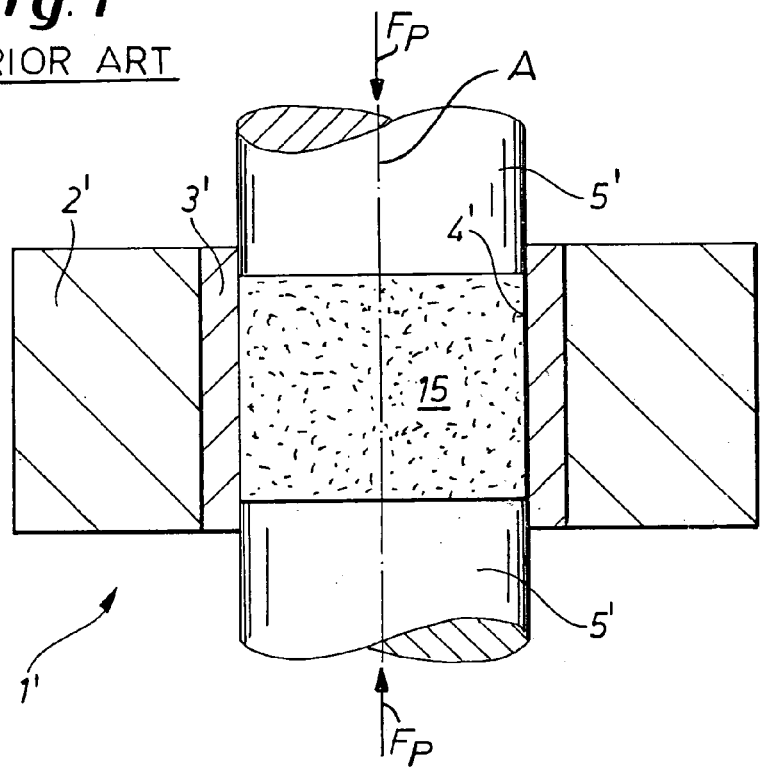
Fig. 1 PRIOR ART
FIG. 1 is an axial section through a standard prior-art powder-pressing system.

As seen in FIG. 1 a standard prior-art mold system 1' has a basically annular mold body 2' in which is fitted a hardened-steel cylindrical liner tube 3' centered on an axis A' and having a cylindrical inner surface 4'. Two slungers 5' are introduced axially into the ends of the liner tube 3' to exert an axial force $F_P$ on a mass 15' of powder confined within it. As the pressure $F_P$ is very large, the liner tube 3' and body 2' will expand at least microscopically perpendicular to the axis A' so that, when the plungers 5' are withdrawn, the compacted mass 15' will be solidly stuck in the liner 3'.

Figure 2:
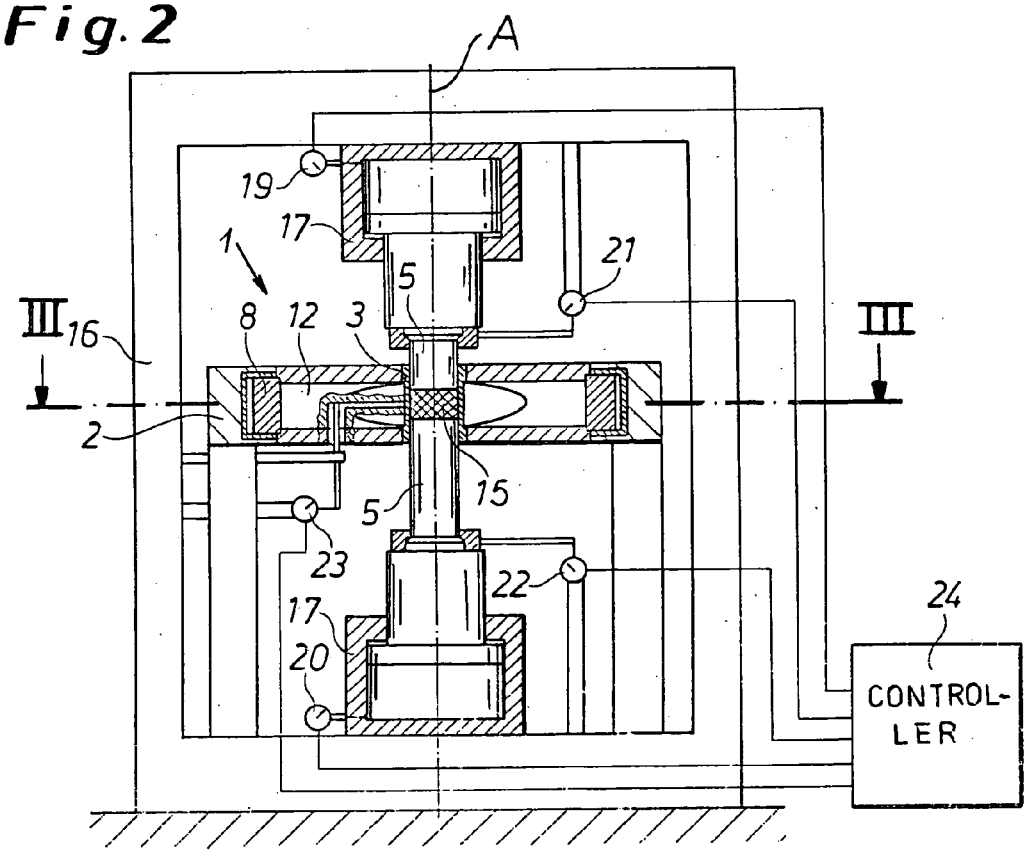
FIG. 2 is a largely schematic view illustrating a powder press according to the invention.
Figure 3:
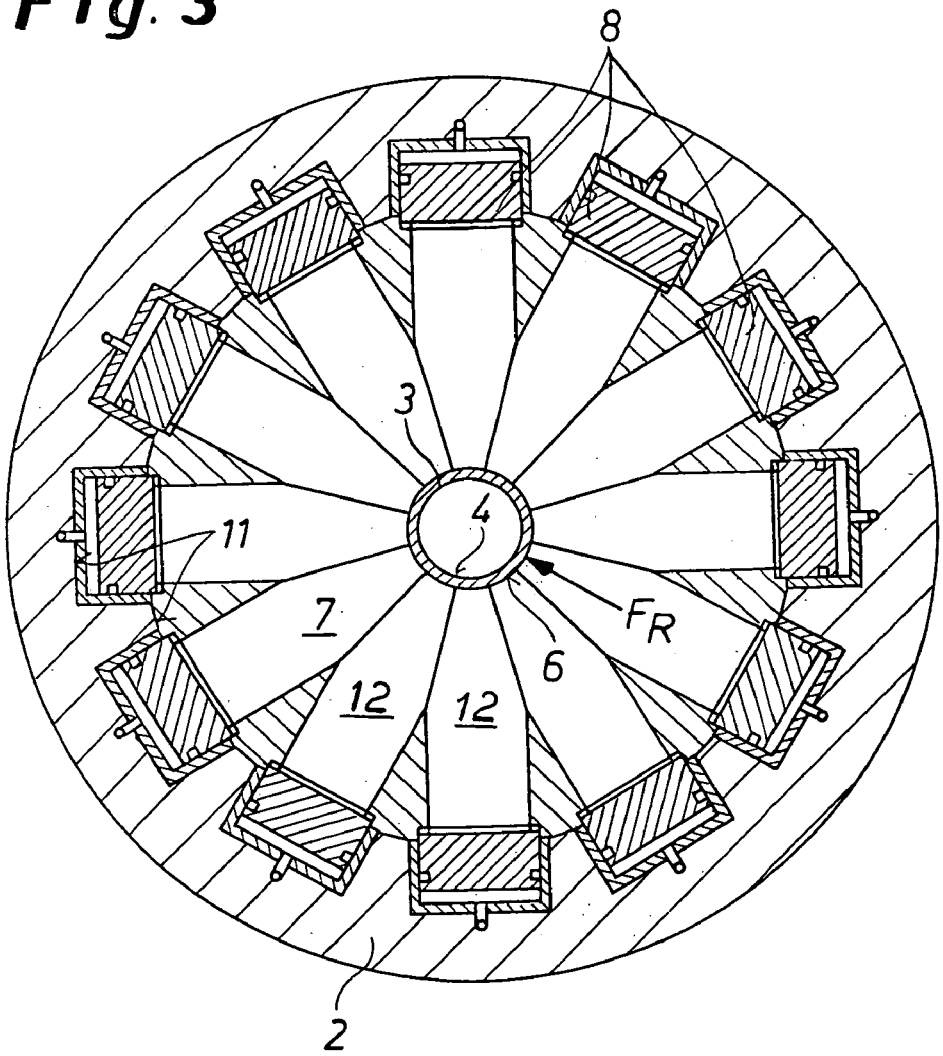
FIG. 3 is a horizontal section taken along line III—III of FIG. 2.

According to the invention as shown in FIGS. 2 and 3, a mold 1 has an annular body 2 defining a chamber 7 in the center or which a hardened-metal liner tube 3 with an inner surface 4 and an outer surface 5 extends along an axis A. Plungers 5 can be fitted axially into the ends of the liner tube 3 to compress the mass 15 therein. These plunger 5 are received in cylinders 17 pressurized from a controller 24 connected to pressure sensors 19 and 20 on the cylinders 17, to position detectors 21 and 22 associated with the plungers 5, and with a radial-displacement sensor 23 associated with the liner tube 3. A frame 16 holds the cylinders 17 and the mold body 2.

Here an array of radially displaceable and radially equispaced pistons 8 are seated in the mold body 2 and bear radially inward via rigid members 12 on the outer surface 6 of the liner tube 3 with a force FR.

Figure 4A:
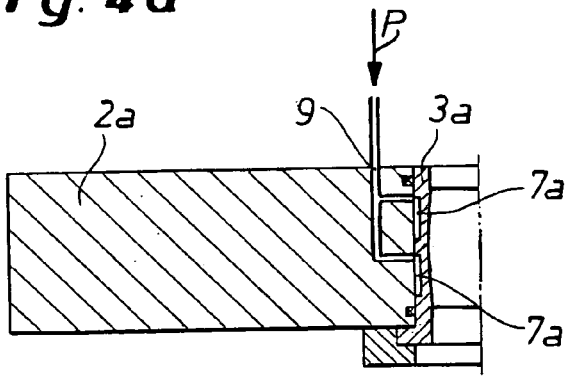
FIGS. 4*a* and 4*b* are vertical and horizontal sections through a second press according to the invention.
Figure 4B:
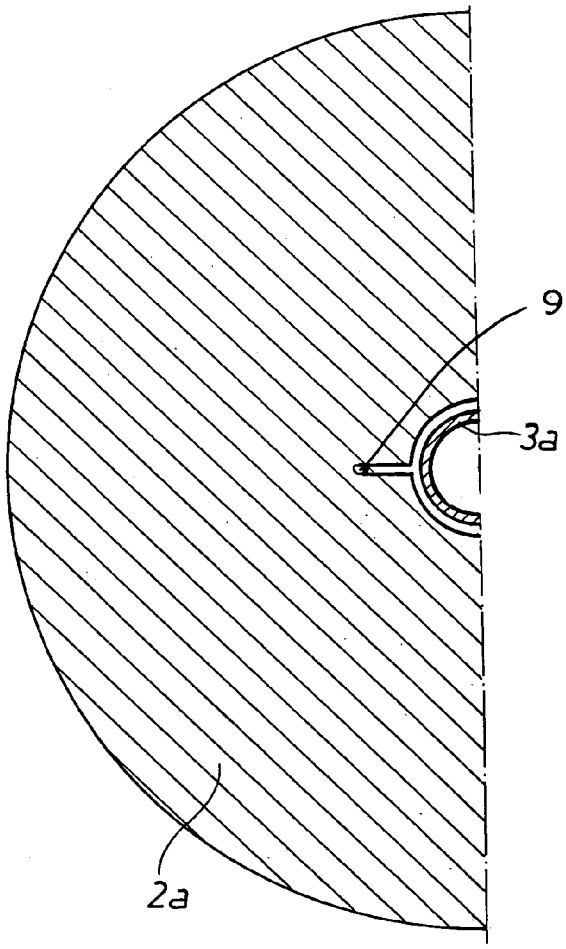

In FIGS. 4*a* and 4*b* a pair of annular chambers 7*a* are actually formed in the liner sleeve 3*a* and are pressurized at a pressure P by means partially illustrated as a feed passage 9 formed in the mold body 2*a*. This makes it possible to oppose a countervailing force to the radially outwardly directed force effective on the sleeve 3*a* when a mass in it is compressed axially.

Figure 5A:
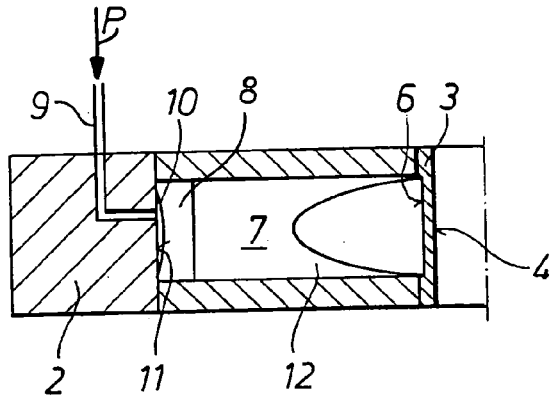
FIGS. 5*a* and 5*b* are vertical and horizontal sections through a third press according to the invention.
Figure 5B:
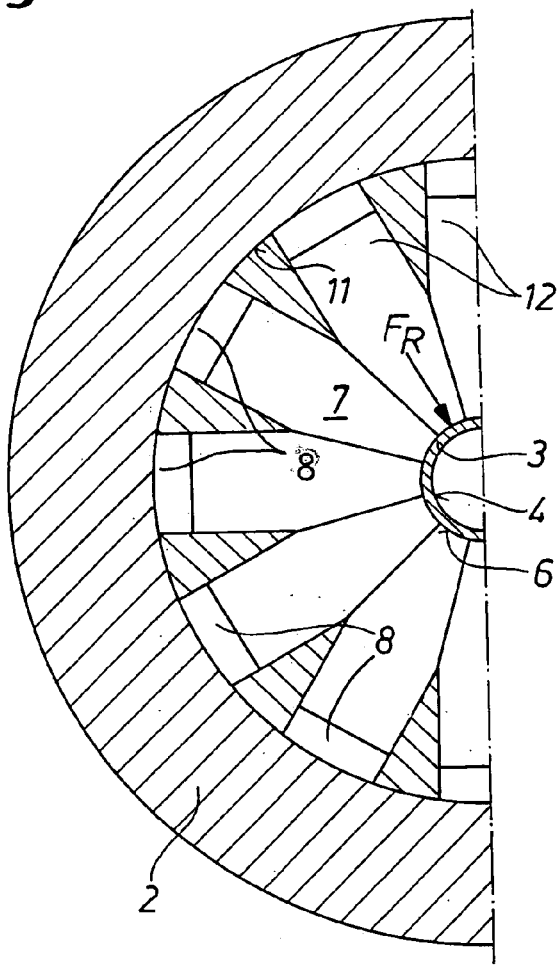

The system of FIGS. 5*a* and 5*b* corresponds generally to that of FIGS. 2 and 3. Here chambers are formed between the outer ends of the pistons 8 and an inner face 11 of the mold body 2, and passages 9 are used to pressurize them. The members 12 are radially inwardly tapered so they fit snugly together and uniformly radially compress the liner 3.

Figure 6A:
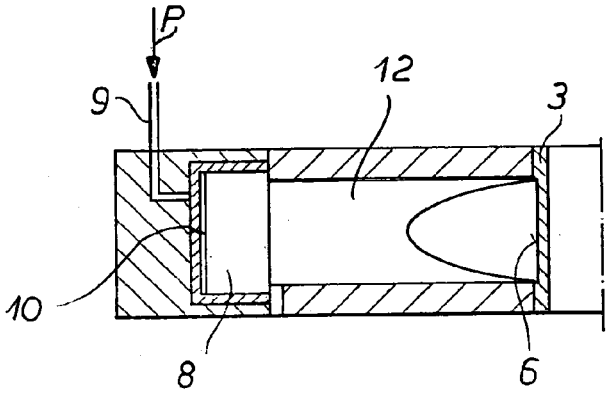
FIGS. 6*a* and 6*b* are vertical and horizontal sections through a fourth press according to the invention.
Figure 6B:
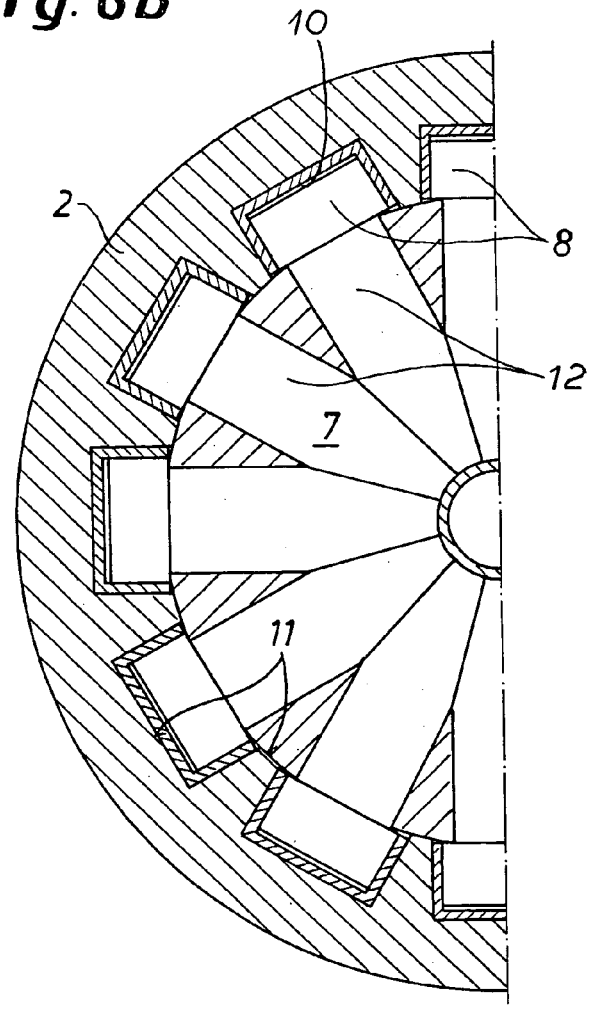

In FIGS. 6*a* and 6*b* the pistons 8 are of greater surface area in chambers 10 that are pressurized via the lines 9 than where the members 12 engage the outer face 6 of the sleeve 3. Thus there is force multiplication.

Figure 7A:
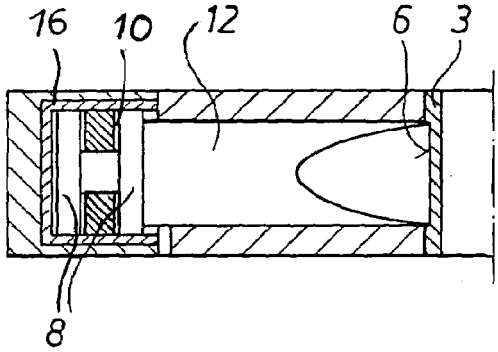
FIGS. 7*a* and 7*b* are vertical and horizontal sections through a fifth press according to the invention.
Figure 7B:
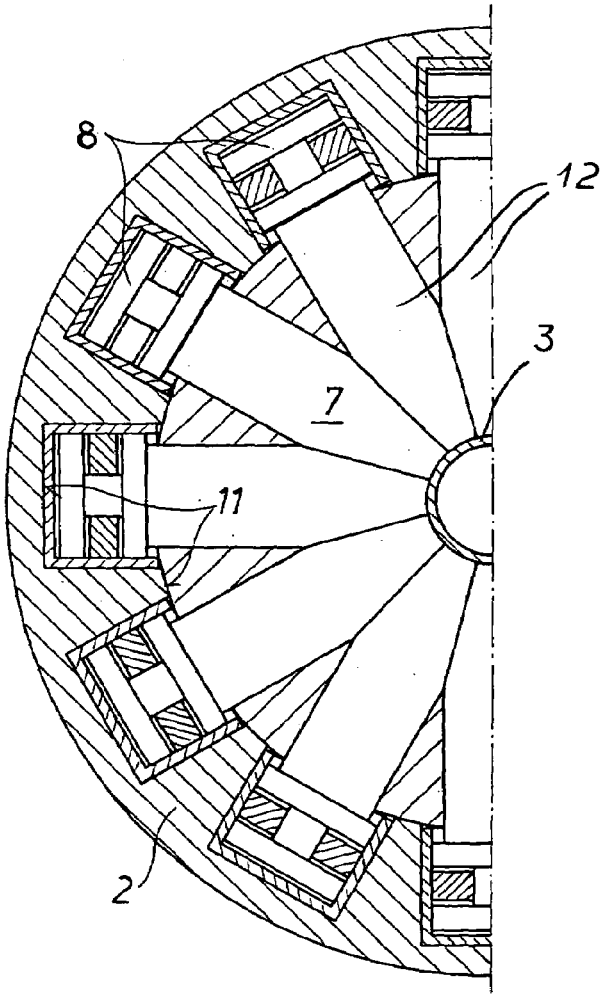

In the system of FIGS. 7*a* and 7*b* the pistons 8 are double and each in a respective chamber 10, so that a great deal of force can be exerted radially inward by the members 12 on the sleeve 3.

Figure 8A:
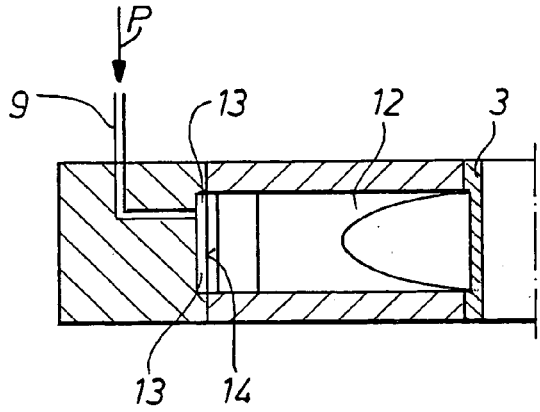
FIGS. 8*a* and 8*b* are vertical and horizontal sections through a sixth press according to the invention.
Figure 8B:
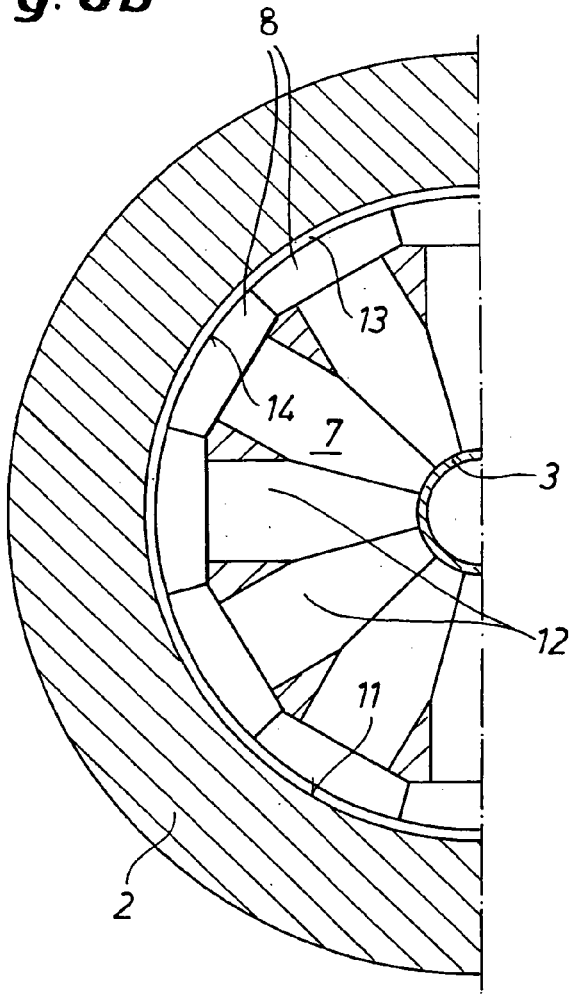

FIGS. 8*a* and 8*b* show a system where the pistons 8 form a continuous outer surface 14 confronting the mold-body surface 11 and forming therewith an annular chamber 13. Pressurization o this chamber 13 drives in all of the pistons 8 with their force-transmitting members to radially inwardly compress the liner sleeve 3. A further sleeve or membrane may overly the surface 14 to reduce the possibility of leakage between adjacent pistons 8.

Figure 9A:
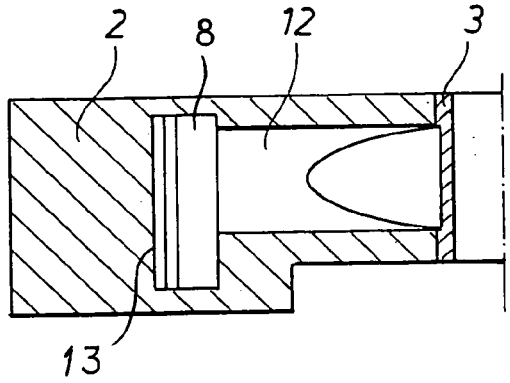
FIGS. 9*a* and 9*b* are vertical and horizontal sections through a seventh press according to the invention.
Figure 9B:
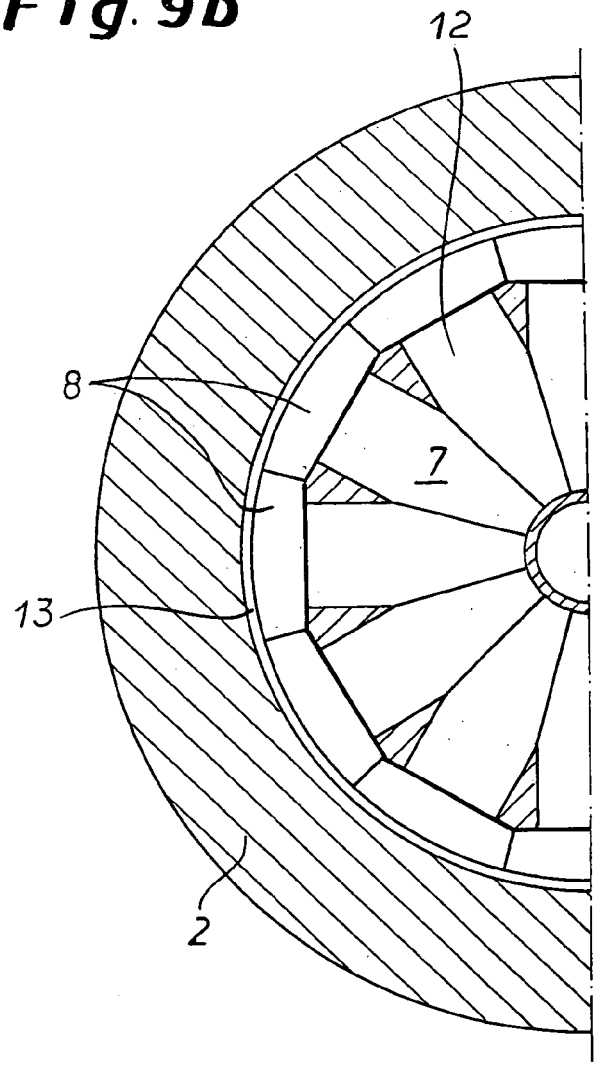

FIGS. 9*a* and 9*b* show an arrangement like that of FIGS. 8*a* and 8*b*, except that the pistons 8 are enlarged for force multiplication as in FIGS. 6*a* and 6*b*.

Figure 10A:
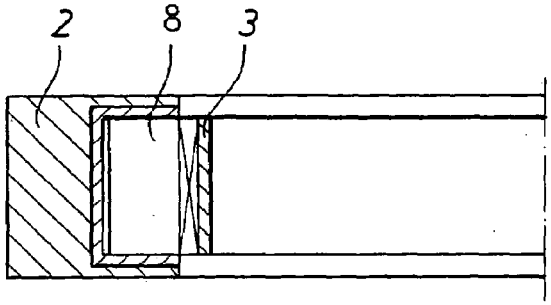
FIGS. 10*a* and 10*b* are vertical and horizontal sections through an eighth press according to the invention.
Figure 10B:
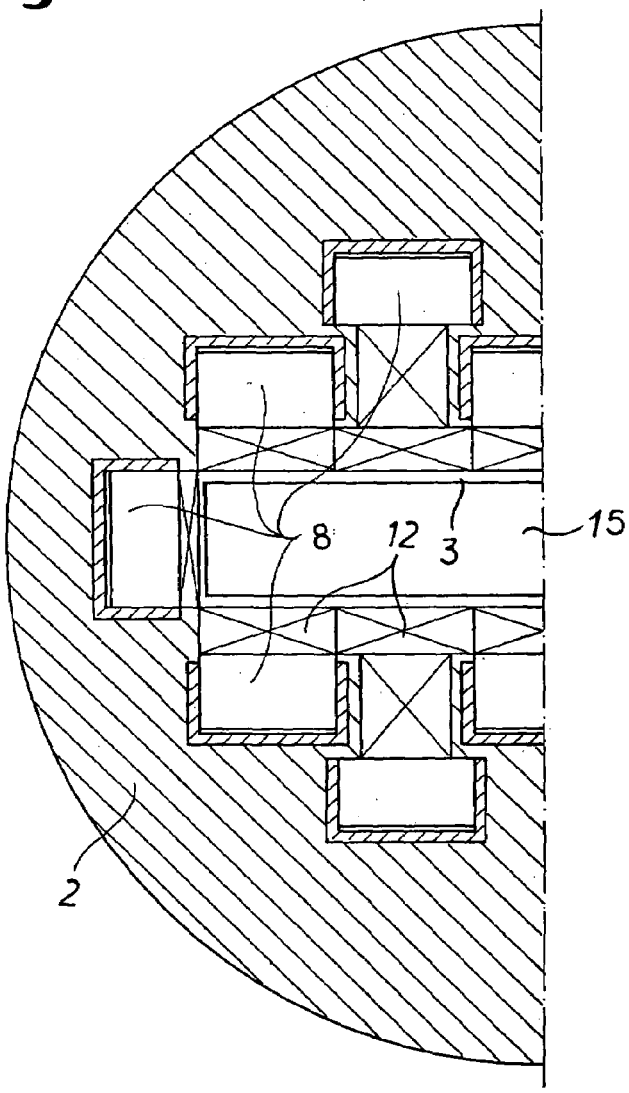

An elongated workpiece is formed in the arrangement of FIGS. 10*a* and 10*b*. Here a plurality of pistons 8 engage the sleeve 3, some transversely and some end-wise, via respective force-transmitting members 12.

Figure 11A:
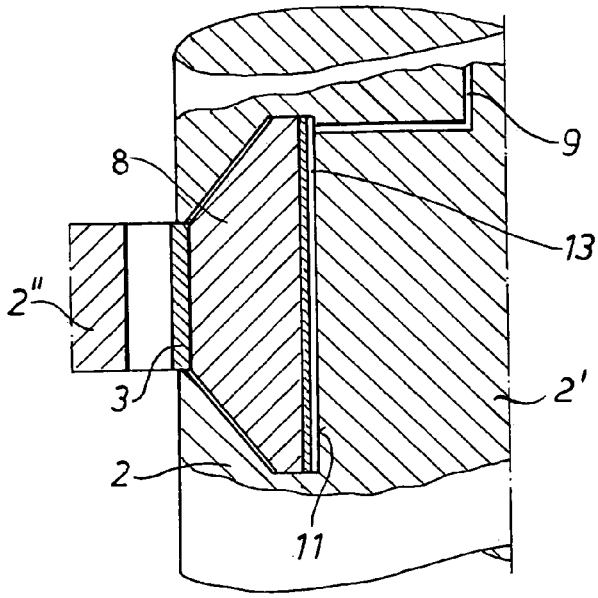
FIGS. 11*a* and 11*b* are vertical and horizontal sections through a ninth press according to the invention.
Figure 11B:
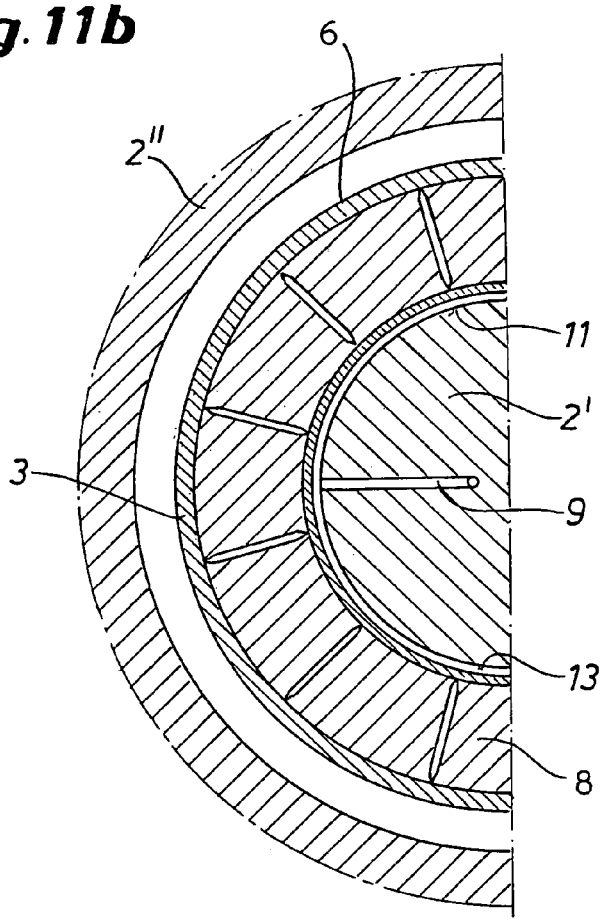

In FIGS. 11*a* and 11*b* there is a cylindrical and solid inner mold part 2' and a coaxial but hollow outer part 2", and the passage 9 is formed in the center part 2' to radially outwardly press on pistons 8 bearing radially outward on the inner surface of the liner sleeve 3, between whose outer surface 6 and the part 2" the powder mass or partially formed workpiece is compressed. The plunger here would be of the same annular shape as the workpiece.

Figure 12A:
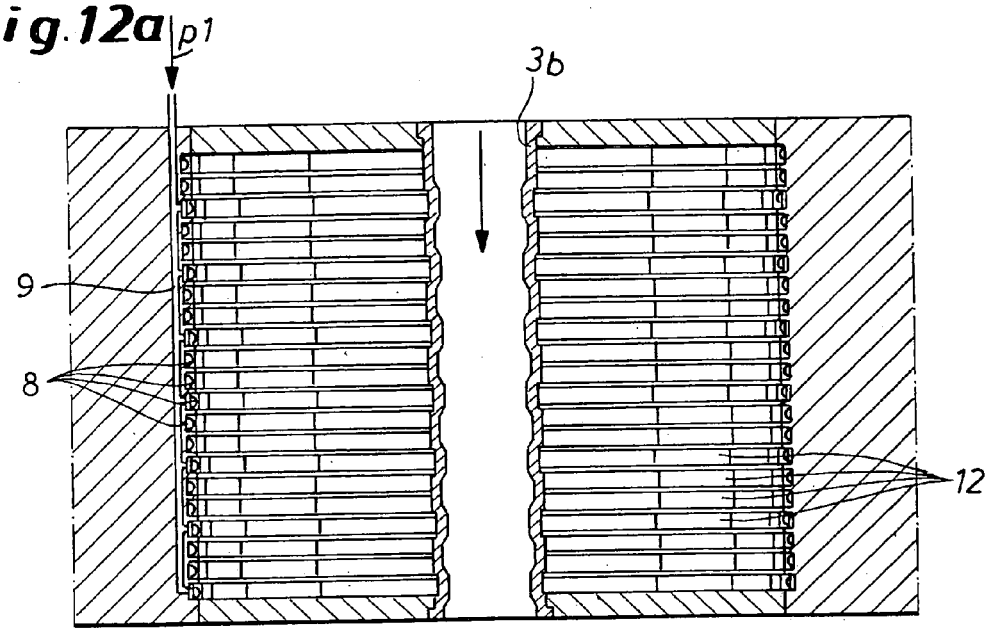
FIGS. 12*a* and 12*b* are vertical and horizontal sections through a tenth press according to the invention.
Figure 12B:
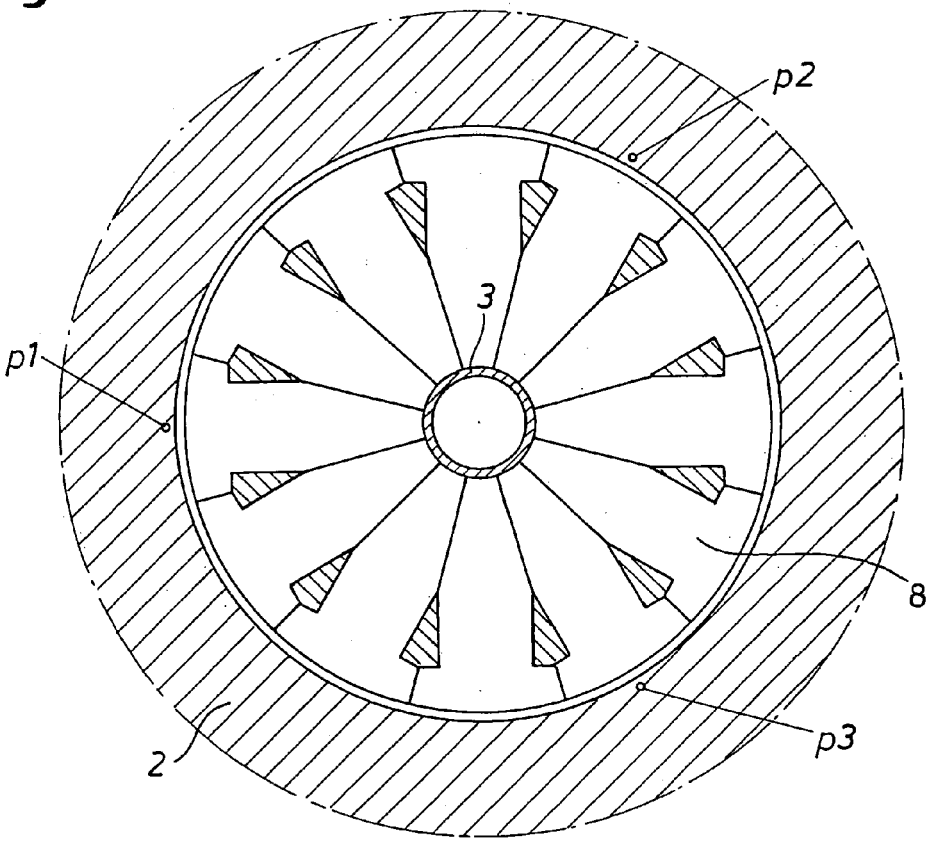

FIGS. 12*a* and 12*b* show an arrangement with a stack of pistons 8 and force-transmitting members 12 bearing on respective axially offset regions of a corrugated sleeve 3*b*. The pistons 8 are also angularly distributed and divided into three groups fed via respective lines 9 at different pressures p1, p2, and p3 to differently prestress the liner 3*b*.

Figure 13:
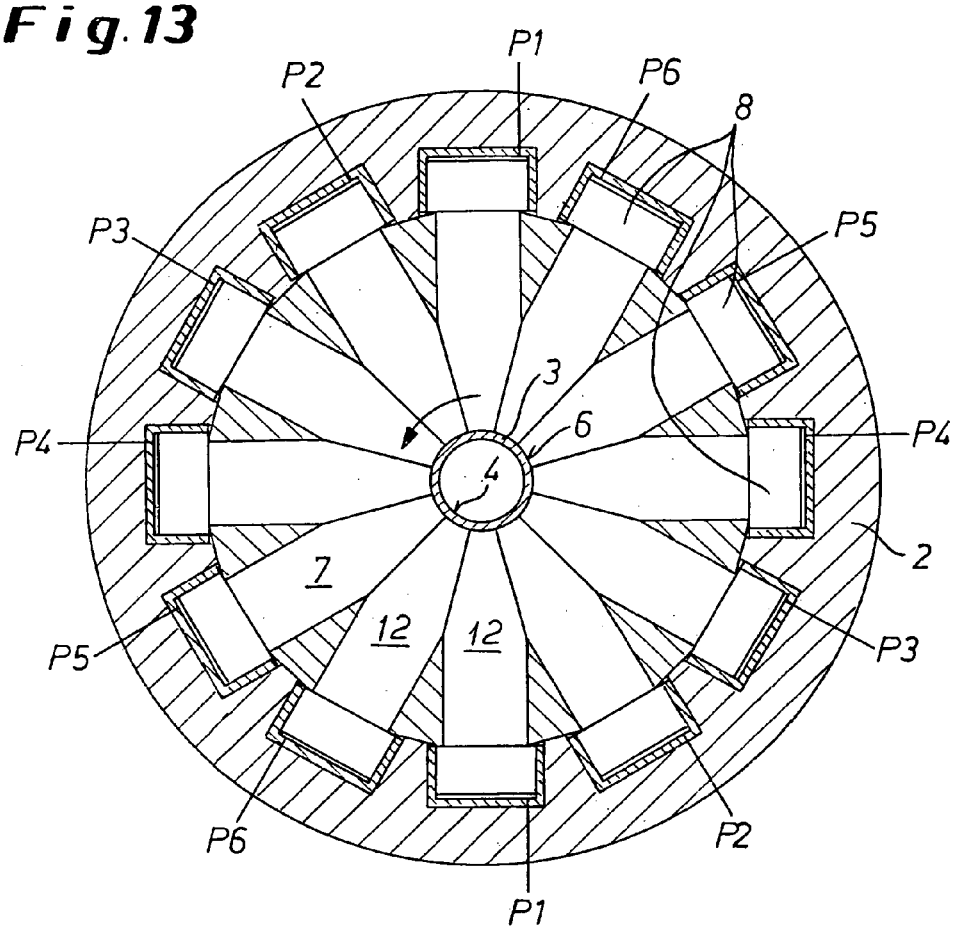
FIG. 13 is a view like FIG. 3 showing a variation on the press of FIGS. 2 and 3.
Figure 14:
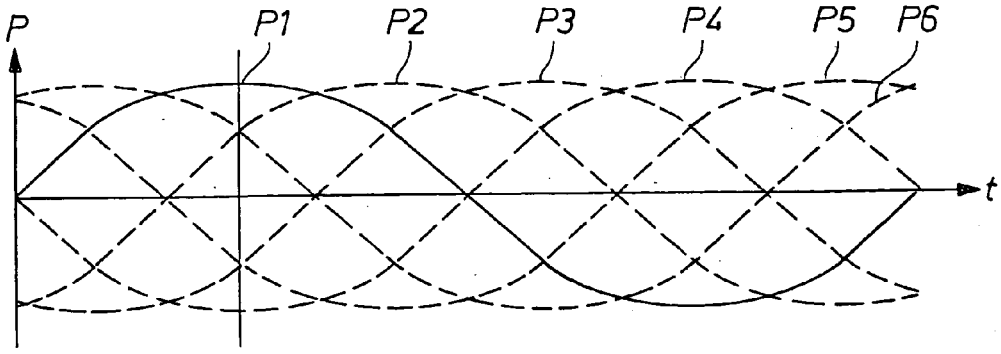
FIG. 14 is a diagram illustrating the operation of the FIG. 13 variant.

Finally, FIG. 13 shows an arrangement much like that of FIGS. 5*a* and 5*b* but where there are twelve pistons 8 connected in six different groups, with diametrally opposite pistons 8 paired in the same group, for pressurization at six different pressures P1, P2, P3, P4, P5, and P6. Furthermore as shown in FIG. 14 the individual pressures P1–P6 are varied so as to rise and fall sinusoidally one after the other. This has a kneading effect on the liner sleeve 3 ensuring excellent compaction of the mass in it.

According to the invention, the liner sleeve 3 is actually a slight amount oversized, that is bigger than the finished workpiece. It is compressed to the desired size and then the powder-pressing operation takes place. When the compression is released, the liner returns to its normal size and the finished workpiece is easily slipped out of or off it. In fact the mold body is dimensioned such that the liner is a snug fit in it when at its normal size. Only during the powder-pressing operation is the space between the surface of the mold-body chamber and the surface of the liner tube filled with pressurized oil and are these surfaces not actually touching each other.

With the hydrostatic bracing of the liner according to the invention, this part does not deform during the pressing operation when typically the mass of powder is compressed under enormous pressure. Since the liner does not deform, nor does the mold body around it, these parts have a much longer service life.

It is also possible according to the invention to increase the radial prestressing force on the liner as the axial force is applied to the workpiece, e.g. a powder mass, contained in the liner. The radial compression is somewhat greater than the axial compression so that when the axial and radial compressions are at their maximum, the liner is slightly compressed radially. Hence when the pressures are relieved, the liner tube will relax and actually release the workpiece, as the liner is deformed elastically and the workpiece plastically. The liner is only deformed sufficiently that, when pressure is released, demolding is easy.

Furthermore according to the invention the prestressing pressure deforming the liner can be kept the same through the entire axial pressing operation. Thus as the plungers compress the workpiece, the liner wall that was deformed in one direction will deform back oppositely, still nonetheless not returning to its size when fully relaxed. This is slightly complicated by the normal warming action during axial compression of the workpiece, but such thermal dimension changes are easily accounted for.

We claim:

1. A method of pressing a mass into a coherent workpiece in a mold assembly having a mold body defining a chamber, a mold liner in the chamber having a generally cylindrical pressing surface centered on an axis, directed in one radial direction, and defining a mold cavity and an opposite surface directed in an opposite radial direction, and a plunger engageable axially in the cavity, the method comprising the steps of:

confining the mass in the cavity in engagement with the pressing surface and with the plunger;

pressing the plunger axially against the mass and thereby axially compressing the mass;

exerting a radial force in the one radial direction between the mold body and the opposite surface of the liner and thereby elastically deforming the liner in the one radial direction toward the mass and radially compressing the liner and mass in the cavity; and varying the radial force in different axially spaced regions of the liner during axial compression of the mass.

2. The method defined in claim 1 wherein the chamber is substantially closed and the force is exerted by pressurizing the chamber around the liner.

3. The method defined in claim 1 wherein the liner is elastically deformed before the plunger is pressed axially against the mass.

4. The method defined in claim 1, further comprising the steps of:

retracting the plunger axially out of engagement with the mass after compressing the mass; and releasing the force on the liner in the one direction and thereby relaxing the liner out of engagement with the mass.

5. The method defined in claim 1, further comprising the step of periodically varying the pressure applied in the one direction to the liner during axial compression of the mass by the plunger.

6. The method defined in claim 1 wherein the force is exerted on the liner to elastically deform it to a predetermined desired workpiece size.

7. The method defined in claim 1 wherein the regions are also spaced angularly.

* * * * *